US010331059B2

(12) United States Patent
Kato et al.

(10) Patent No.: US 10,331,059 B2
(45) Date of Patent: Jun. 25, 2019

(54) DEVELOPING DEVICE AND IMAGE FORMING APPARATUS HAVING A TONER CONCENTRATION DETECTOR AND A RETAINING MEMBER THAT RETAINS THE DEVELOPER IN THE TONER CONCENTRATION DETECTING REGION

(71) Applicant: FUJI XEROX CO., LTD., Tokyo (JP)

(72) Inventors: Masanori Kato, Ebina (JP); Tomio Ohnuki, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 3 days.

(21) Appl. No.: 15/251,870

(22) Filed: Aug. 30, 2016

(65) Prior Publication Data

US 2017/0227886 A1 Aug. 10, 2017

(30) Foreign Application Priority Data

Feb. 4, 2016 (JP) ..... 2016-020015

(51) Int. Cl.
*G03G 15/08* (2006.01)

(52) U.S. Cl.
CPC ..... *G03G 15/0849* (2013.01); *G03G 15/0893* (2013.01)

(58) Field of Classification Search
CPC ..... G03G 15/0849; G03G 15/0893
USPC ..... 399/58
See application file for complete search history.

(56) References Cited

U.S. PATENT DOCUMENTS

| | | | | |
|---|---|---|---|---|
| 9,176,427 | B2 | 11/2015 | Tamaki et al. | |
| 2007/0196116 | A1* | 8/2007 | Watanabe | G03G 15/0893 399/30 |
| 2011/0158700 | A1* | 6/2011 | Iwata | G03G 15/0889 399/254 |
| 2011/0286769 | A1* | 11/2011 | Mihara | G03G 15/0879 399/254 |
| 2014/0270817 | A1* | 9/2014 | Ikebata | G03G 15/0824 399/27 |
| 2015/0078786 | A1 | 3/2015 | Tamaki et al. | |

FOREIGN PATENT DOCUMENTS

| | | | |
|---|---|---|---|
| JP | 2009-222924 | A | 10/2009 |
| JP | 2009-222927 | A | 10/2009 |
| JP | 2015-060017 | A | 3/2015 |

* cited by examiner

*Primary Examiner* — Walter L Lindsay, Jr.
*Assistant Examiner* — Philipmarcus T Fadul
(74) *Attorney, Agent, or Firm* — Oliff PLC

(57) ABSTRACT

A developing device includes a developer holding member that holds a developer, a supplying member that supplies the developer to the developer holding member, a transport member that transports the developer while passing the developer onto the supplying member through a passing member, the transport member including a discharge unit that discharges excess developer and that is provided downstream of the passing member in a transport direction, a detecting unit that is provided upstream of the discharge unit in the transport direction and that detects a toner concentration, and a retaining member that includes a non-application portion that prevents action of a force for transporting the developer radially outward and that retains the developer in a region corresponding to the detecting unit of the transport member.

10 Claims, 10 Drawing Sheets

DEVELOPING DEVICE AND IMAGE FORMING APPARATUS HAVING A TONER CONCENTRATION DETECTOR AND A RETAINING MEMBER THAT RETAINS THE DEVELOPER IN THE TONER CONCENTRATION DETECTING REGION

CROSS-REFERENCE TO RELATED APPLICATIONS

This application is based on and claims priority under 35 USC 119 from Japanese Patent Application No. 2016-020015 filed Feb. 4, 2016.

BACKGROUND

Technical Field

The present invention relates to a developing device and an image forming apparatus.

SUMMARY

According to an aspect of the invention, a developing device includes a developer holding member that holds a developer, a supplying member that supplies the developer to the developer holding member, a transport member that transports the developer while passing the developer onto the supplying member through a passing member, the transport member including a discharge unit that discharges excess developer and that is provided downstream of the passing member in a transport direction, a detecting unit that is provided upstream of the discharge unit in the transport direction and that detects a toner concentration, and a retaining member that includes a non-application portion that prevents action of a force for transporting the developer radially outward and that retains the developer in a region corresponding to the detecting unit of the transport member,

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the invention will be described with reference to the drawings.

First Exemplary Embodiment

Figure 1:
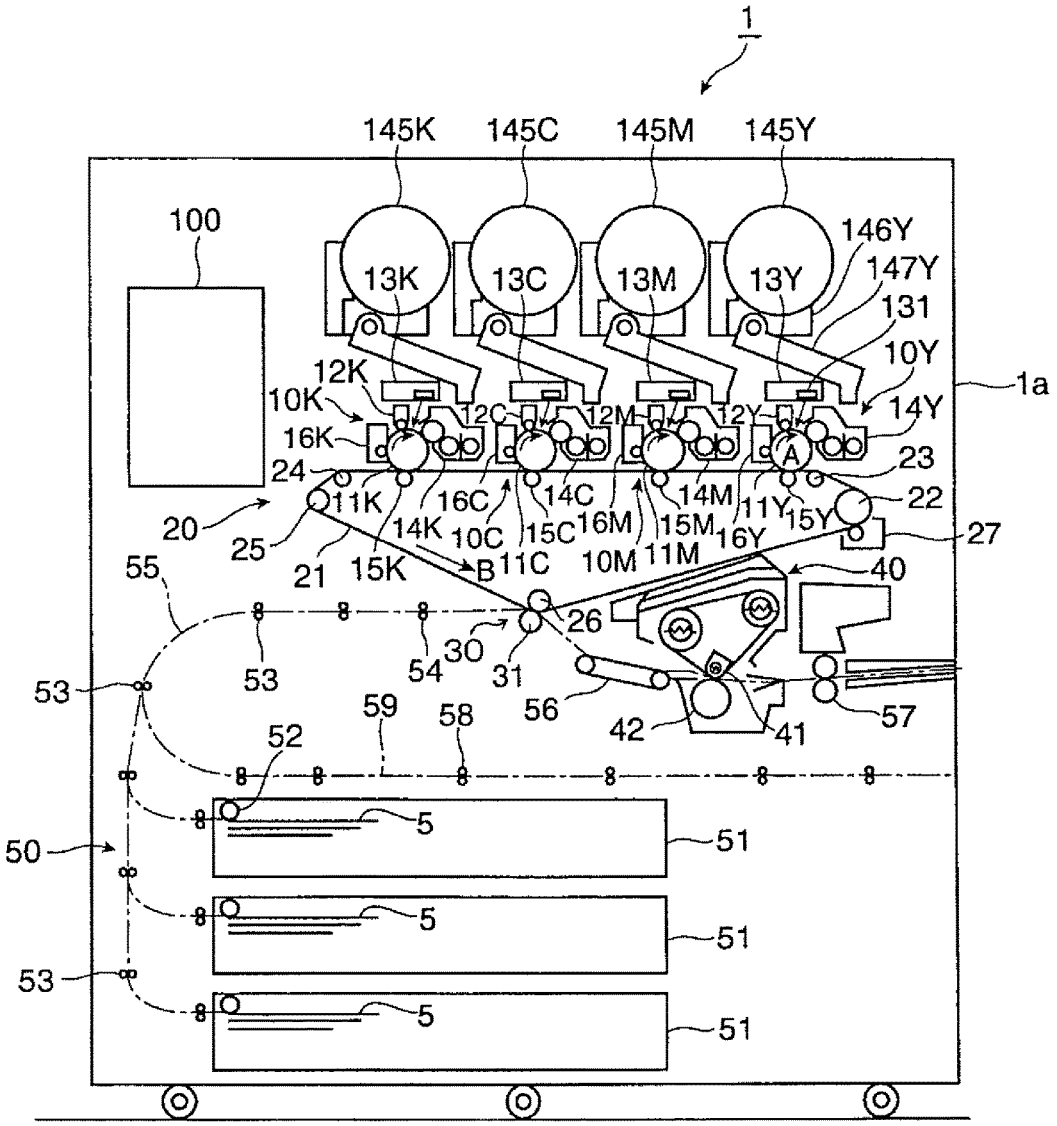
FIG. 1 is an overall configuration diagram illustrating an image forming apparatus to which a developing device according to a first exemplary embodiment of the invention is applied.
Figure 2:
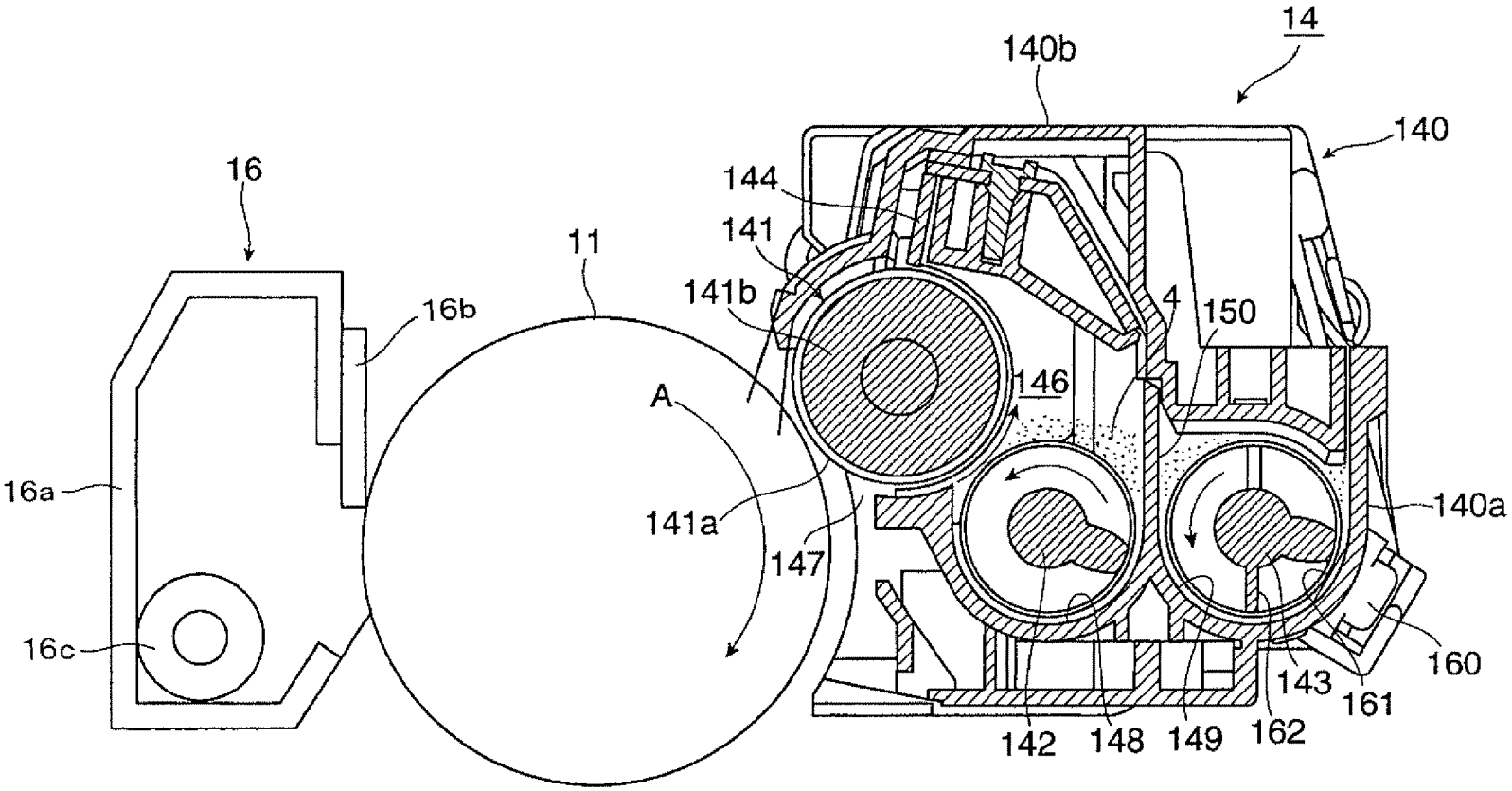
FIG. 2 is a configuration diagram illustrating an image forming unit of the image forming apparatus according to the first exemplary embodiment of the invention.

FIG. 1. illustrates an overall configuration of an image forming apparatus to which a developing device according to a first exemplary embodiment of the invention is applied. FIG. 2 an enlarged view illustrating main parts (including an image forming device) of the image forming apparatus.

Entire Configuration of Image Forming Apparatus

An image forming apparatus 1 according to the first exemplary embodiment is configured as, for example, a color printer. The image forming apparatus I includes plural image forming devices 10 that form a toner image which is developed with toners which configure developer, an intermediate transfer device 20 that holds each of the toner images formed by each of the image forming devices 10 and that transports the toner image to a secondary transfer position at which the toner image is finally secondarily transferred onto recording paper 5, which is an example of a recording medium, a paper feeding device 50 that houses and transports the recording paper 5 which is required to be supplied to the secondary transfer position of the intermediate transfer device 20, and a fixing device 40 that fixes the toner image which has been secondarily transferred by the intermediate transfer device 20 on the recording paper 5. In FIG. 1, a main body of the image forming apparatus 1 is indicated by 1*a*, and the main body la includes a supporting structure member, an exterior cover, and the like. In addition, a dashed line in FIG. 1 indicates a main transporting path on which the recording paper 5 is transported in the apparatus main body 1 a.

The image forming devices 10 are configured with the four image forming devices 10Y, 10M, 10C, and 10K that are dedicated to form a toner image in each of four colors, such as yellow (Y), magenta (M), cyan (C), and black (K). These four image forming devices 10 (Y, M, C, and K) are disposed so as to be arranged in one line in a space inside the main body la in a horizontal direction.

As illustrated in FIG. 1 and FIG. 2, the image forming devices 10 (Y, M, C, and K) include rotating photoconductor drums 11 (Y, M, C, and K) respectively, which are an example of an image carrier. In the vicinity of the photoconductor drams 11 (Y, M, C, and K), mainly the following devices are disposed as an example of a toner image forming unit. The devices that are mainly disposed are charging devices 12 (Y, M, C, and K) that charge a circumferential surface (image holding surface) of the photoconductor drums 11 (Y, M, C, and K) on which image forming is possible such that the circumferential surface is charged to have the required electric potential, exposure devices 13 (Y, M, C, and K) that irradiate the charged circumferential surfaces of the photoconductor drums 11 (Y, M, C, and K) with light based on image information (signal) to form an electrostatic latent image in each color which has a potential difference, developing devices 14 (Y, M, C, and K) that are an example of a developing unit which develop the electrostatic latent image with the toner in the developer in the corresponding color (Y, M, C, and K) and turn into a toner image, primary transfer devices 15 (Y, M, C, and K) that are an example of a primary transfer unit which transfers each of the toner images onto the intermediate transfer device 20, and drum cleaning devices 16 (Y, M, C, and K) that clean the image holding surface of the photoconductor drum 11 after a primary transfer by eliminating attached substances, such as the toner which has remained and attached to the image holding surface.

The photoconductor drum 11 forms the image holding surface that has a photoconductive layer (photosensitive layer), which is made of photosensitive materials, on the grounded circumferential surface of a cylindrical or columnar base member. The photoconductor drum 11 is supported so as to be capable of rotating in a direction indicated by an arrow A by motive power being transmitted from a driving device (not illustrated), The charging device 12 is configured as a contact-type charging roll that is disposed in a state of maintaining contact with the photoconductor drum 11. Charging voltage is supplied to the charging device 12. In a case where the developing device 14 conducts reversal developing, electric current or voltage that has the same polarity with the toner charging polarity (negative polarity) supplied from the developing device 14 is supplied as the charging voltage. A non-contact type charging device including a scorotron that is disposed in a state of not being in contact with the surface of the photoconductor drum 11 maybe used as the charging device 12.

The exposure device 13 forms an electrostatic latent image by the charged circumferential surface of the photoconductor drum 11 being deflection-scanned by the semiconductor laser 131 emitting light (a solid line with an arrowhead) configured depending on image information input to the image forming apparatus I. The exposure devices 13 corresponding to the image forming devices 10Y, 10M, 10C, and 10K for yellow (Y), magenta (M), cyan (C), and black (K) are provided. Once it becomes time to form a latent image, full-color or black-and-white image information (signal) input to the image forming apparatus 1 by any unit is transmitted to the exposure device 13. As the exposure device 13, an LED printer head may be used, which forms an electrostatic latent image by the photoconductor drum 11 being irradiated with light corresponding to image information, emitted by a light emitting diode (LED) that includes plural light emitting elements placed along an axial direction of each photoconductor drum 11 of the image forming device 10.

As illustrated in FIG. 2, each of the developing devices 14 (Y, M, C, and K) includes a developing roll 141, a supply transport member 142, an agitation transport member 143, a layer thickness regulating member 144, and the like being disposed in a device housing 140 in which an opening portion and a housing chamber for the developer 4 are formed. The developing roll 141 is an example of a developer holding member that holds and transports the developer 4 to a developing region which faces the photoconductor drum 11. The supply transport member 142, including a screw auger, agitates and supplies the developer 4 to the developing roil 141. The agitation transport member 143, including the screw auger, agitates and transports the developer 4 while exchanging the developer 4 with the supply transport member 142. The layer thickness regulating member 144 regulates an amount of the developer (layer thickness) held by the developing roll 141. A two-component developer that contains a non-magnetic toner and magnetic carrier is used as the developer 4 in each of the four colors (Y, M, C, and K). The developing devices 14 (Y, M, C, and K) will be described in detail later.

The primary transfer devices 15 (Y, M, C, and K) are contact-type transfer devices that rotate while maintaining contact with the circumference of the photoconductor drum 11 via an intermediate transfer belt 21 and that include a primary transfer roll to which primary transfer voltage is supplied. As the primary transfer voltage, voltage of direct current that has reverse polarity with respect to the toner charging polarity is supplied from a power source device (not illustrated).

As illustrated in FIG. 2, the drum cleaning device 16 includes a container-shaped main body 16*a* of which a part is opened, a cleaning plate 16*b* that is disposed so as to be in contact with, at a required pressure, the circumferential surface of the photoconductor drum 11 after the primary transfer, and that cleans the photoconductor drum 11 by eliminating attached substances, including a residual toner, and a sending member 16*c*, including the screw auger, which recovers and transports the attached substances, including the toner, eliminated by the cleaning plate 16*b* so as to be sent out to a recovery system (not illustrated), and the like. A plate shaped member (for example, cleaning blade) made of rubber or the like is used as the cleaning plate 16*b*.

As illustrated in FIG. 1, the intermediate transfer device 20 is disposed at a position below each of the image forming devices 10 (Y, M, C, and K). The intermediate transfer device 20 mainly includes the intermediate transfer belt 21, plural belt supporting rolls 22 to 26, a secondary transfer device 30, and a belt cleaning device 27. The intermediate transfer belt 21 passes through a primary transfer position between the photoconductor drum 11 and the primary transfer device 15 (primary transfer roll), and rotates in a direction indicated by an arrow B. The plural belt supporting rolls 22 to 26 rotatably support the intermediate transfer belt 21 by holding the intermediate transfer belt 21 from an inner surface thereof in a desirable state. The secondary transfer device 30 is an example of a secondary transfer unit that has a secondary transfer roll 31 which is disposed on an outer peripheral surface (image holding surface) side of the intermediate transfer belt 21 supported by the belt supporting roll 26, and that secondarily transfers the toner image on the intermediate transfer belt 21 onto the recording paper 5. The belt cleaning device 27 cleans the intermediate transfer belt 21 by eliminating the attached substances, including paper dust and a toner that remain on and are attached to the outer peripheral surface of the intermediate transfer belt 21, after passing through the secondary transfer device 30.

An endless belt that is made of, for example, a material obtained by a carbon black or other resistance adjusting agents being dispersed in a polyimide resin, a polyamide resin or other synthetic resins is used as the intermediate transfer belt 21. In addition, the belt supporting roll 22 is configured as a driving roll that is rotation-driven by the driving device (not illustrated). The belt supporting rolls 23 and 24 are configured as surfacing rolls that form image forming surfaces of the intermediate transfer belt 21. The belt supporting roll 25 is configured as a tension applying roll that exerts tension on the intermediate transfer belt 21, and as a meandering correction roll that corrects the belt walk of the intermediate transfer belt 21. The belt supporting roll 26 is configured as a rear surface supporting roll of the secondary transfer.

As illustrated in FIG. 1, the secondary transfer device 30 is a contact-type transfer device that is provided with the secondary transfer roll 31 which rotates while maintaining contact with the peripheral surface of the intermediate transfer belt 21 and which configures the secondary transfer unit to which secondary transfer voltage is supplied, in the secondary transfer position that is an outer peripheral surface portion of the intermediate transfer belt 21 supported by the belt supporting roll 26 of the intermediate transfer device 20. The secondary transfer device 30 includes the secondary transfer roll 31 and the belt supporting roll 26 that is a backup roll. In addition, the voltage of direct current that has the opposite polarity to the toner charging polarity or the same polarity as the toner charging polarity is supplied as the secondary transfer voltage to the secondary transfer roll 31 or the belt supporting roll 26.

The belt cleaning device 27 has the same configuration as that of the chum cleaning device 16. The belt cleaning device 27 includes a container-shaped main body of which a part is opened, a cleaning plate (not illustrated) that is disposed so as to be in contact with, at a required pressure, the peripheral surface of the intermediate transfer belt 21 after the secondary transfer, and that cleans the intermediate transfer belt 21 by eliminating the attached substances, including a residual toner, and a sending member (not illustrated), including the screw auger, which recovers and transports the attached substances, including the toner, eliminated by the cleaning plate so as to be sent out to a recovery system, and the like.

The fixing device 40 includes a heating rotation member 41, a pressurizing rotating body 42, and the like. The heating rotation member 41 is in the form of a belt or roll heated by a heating unit such that a surface temperature thereof is maintained at a required temperature. The pressurizing rotating body 42 is in the form of a roll or a belt that rotates in a substantially axial direction of the heating rotation member 41 while maintaining contact with the heating rotation member 41 at a predetermined pressure. In the fixing device 40, a contact portion in which the heating rotation member 41 is in contact with the pressurizing rotating body 42 is a fixing processing portion that conducts required fixing processing (heating and pressurizing).

The paper feeding device 50 is disposed at a position below the intermediate transfer device 20. The paper feeding device 50 mainly include plural paper housing members (or a single paper housing member) 51 that house a desirable size and type of the recording paper 5 in a state of being stacked, and a sending device 52 that sends out the recording paper 5 one at a time from the paper housing member 51. The paper housing member 51 is attached, for example, such that the paper housing member 51 may be pulled toward the front side of the main body la (side where a user faces when operating the apparatus).

Examples of the recording paper 5 include plain paper that is used in an electrophotographic system copying machine and printer, thin paper including tracing paper, and an OHP sheet. It is preferable to make the surface of the recording paper 5 as smooth as possible, and for example, coated paper that is obtained by coating the surface of plain paper with a resin or the like, art paper for printing and other so-called pasteboards which have a relatively heavy basis weight may be appropriately used in order to further improve the smoothness of image surface after the fixing.

A sheet transporting path 55 including plural paper transport roll pairs (or single paper transport roll pair) 53 and 54 that transport the recording paper 5, which has been sent out from the paper feeding device 50, to the secondary transfer position, and a transporting guide (not illustrated) is provided between the paper feeding device 50 and the secondary transfer device 30. The paper transport roll pair 54, for example, is configured as rolls (registration rolls) that adjust the transport timing of the recording paper 5. In addition, a transporting belt 56 that transports the recording paper 5 after the secondary transfer, which has been sent out from the secondary transfer roll 31 of the secondary transfer device 30, to the fixing device 40 is provided between the secondary transfer device 30 and the fixing device 40. A paper output roll pair 57 that outputs the fixed recording paper 5, which has been sent out from the fixing device 40, to a paper output unit (not illustrated) provided on a side surface of the main body la is disposed in a portion close to a paper output port formed in the main body 1*a*.

In addition, the paper feeding device 50 includes plural paper transport roll pairs 58 that transport the recording paper 5 from a paper housing member (not illustrated) which is large in capacity and is disposed outside the main body la, and a sheet transporting path 59 including a transporting guide (not illustrated), and the like.

In FIG. 1, each of plural reference numerals 145 (Y, M, C, and K) are placed in a direction orthogonal to the surface of the paper, and each indicates a toner cartridge that houses at least a developer containing a toner to be supplied to the corresponding developing devices 14 (Y, M, C, and. K). In this exemplary embodiment, the toner is housed in the toner cartridges 145 (Y, M, C, and K), and the toner is replenished with a small amount of carrier for trickle development.

In addition, a reference numeral 100 in FIG. 1 indicates a control unit that performs an overall control of an operation of the image forming apparatus 1. The control unit 100 includes a central processing unit (CPU) (not illustrated), a read-only memory (ROM), a random access memory (RAM), a bus that connects the CPU, the ROM, and the like, and a communication interface.

Operation of Image Forming Apparatus

Hereinafter, a basic image forming operation conducted by the image forming apparatus 1 will be described.

Here, an operation of forming a full-color image formed by toner images in four colors (Y, M, C, and K) in combination by using the four image forming devices 10 (Y, M, C, and K) will be described.

Once the image forming apparatus 1 receives command information requiring an image forming operation (printing), the four image forming devices 10 (Y, M, C, and K), the intermediate transfer device 20, the secondary transfer device 30, the fixing device 40, and the like start.

In each of the image forming devices 10 (Y, M, C, and K), first, each of the photoconductor drums 11 rotates in the direction indicated by the arrow A, and each of the charging devices 12 charges a surface of each of the photoconductor drums 11 to have required polarity (negative polarity in the first exemplary embodiment) and electric potential. Then, each of the exposure devices 13 irradiates the charged surface of the photoconductor drum 11 with light emitted based on an image signal obtained by converting image information input in the image forming apparatus 1 to each of color components (Y, M, C, and K), and forms, on the surface, an electrostatic latent image in each color component configured by required potential difference.

Then, each of the image forming devices 10 (Y, M, C, and K) supplies the corresponding color (Y, M, C, and K) toners that have been charged to have the required polarity (negative polarity) from each of the developing rolls 141 to electrostatically attach the corresponding color toner onto the electrostatic latent image in each color component formed on the photoconductor drum 11, thereby developing the electrostatic latent image. As a result of the developing, the electrostatic latent image in each color component formed on the photoconductor drum 11 is obtained as a toner image in each of the four colors (Y, M, C, and K) that has been developed with each of the corresponding color toners.

Next, once the toner image in each color formed on the photoconductor drum 11 of each of the image forming devices 10 (Y, M, C, and K) is transported to the primary transfer position, the primary transfer device 15 primarily transfers the toner image in each color such that the toner images are sequentially superimposed on the intermediate transfer belt 21 of intermediate transfer device 20 which rotates in the direction indicated by the arrow B.

In addition, in each of the image forming devices 10 in which the primary transfer has been completed, the drum cleaning device 16 scrapes and removes the attached substances to clean the surface of the photoconductor drum 11. Accordingly, each of the image forming devices 10 returns to a state where another image forming operation can be implemented.

Next, the intermediate transfer device 20 holds the toner image primarily transferred by the rotation of the intermediate transfer belt 21, and transports to the secondary transfer position. The paper feeding device 50 sends out the required recording paper 5 onto the sheet transporting path 55 in accordance with the image forming operation. On the sheet transporting path 55, the paper transport roll pair 54 that is the registration roll sends out and supplies the recording paper 5 to the secondary transfer position in accordance with transfer timing.

The secondary transfer roll 31 of the secondary transfer device 30 collectively and secondarily transfers the toner image on the intermediate transfer belt 21 onto the recording paper 5 at the secondary transfer position. In addition, in the intermediate transfer device 20 in which the secondary transfer has been completed, the belt cleaning device 27 cleans the intermediate transfer belt 21 by eliminating the toner and other attached substances that have remained on the surface of the intermediate transfer belt 21 after the secondary transfer.

Next, the recording paper 5 on which the toner image has been secondarily transferred is transported to the fixing device 40 via the transporting belt 56 after being peeled off from the intermediate transfer belt 21 and the secondary transfer roll 31. In the fixing device 40, necessary fixing processing (heating and pressurizing) is implemented, and an unfixed toner image is fixed onto the recording paper 5 by the secondarily transferred recording paper 5 being put at and then passed through the contact portion between the rotating heating rotation member 41 and the rotating pressurizing rotating body 42. Finally, when an image forming operation in which an image is formed only on one side is implemented, the recording paper 5 on which fixing has been completed is output by the paper output roll pair 57 to the paper output unit (not illustrated) disposed in the side of the main body 1*a*.

As a result of the operation described above, the recording paper 5 on which a full-color image formed by the four color toner images in combination is formed is printed out.

Configuration of Developing Device

FIG. 2 is a sectional view illustrating a configuration of the developing device according to the first exemplary embodiment.

The developing device 14 includes the device housing 140 that is an example of a device housing member. The device housing 140 mainly has a lower housing 140*a* that is disposed in a lower portion of the developing device 14, and an upper housing 140*b* that is disposed in an upper portion of the developing device 14. The lower housing 140*a* and the upper housing 140*b* are bonded to each other via a spacer member (not illustrated), and a developer housing chamber 146 that houses the two-component developer 4 is fainted in the device housing 140. An opening portion 147 is provided in a region of the device housing 140 facing the photoconductor drum 11. In addition, in the device housing 140, the developing roll 141 that is an example of the developer holding member is disposed so as to be capable of rotating in an arrow direction such that a part thereof is exposed from the opening portion 147. The developing roll 141 is disposed so as to be fixed to an inner portion, and has a magnet roll 141*b* in which a magnetic pole of required polarity is disposed at a required position, and a developing sleeve 141*a* that is disposed in an outer circumference of the magnet roll 141*b* so as to be rotatable at a required speed in the arrow direction. The developing sleeve 141*a* is shaped into a cylinder made of nonmagnetic materials, such as aluminum and n on-magnetic stainless steel.

In the exemplary embodiment, the rotation direction of the developing sleeve 141*a* is set to a direction reverse to the rotation direction of the photoconductor drum 11. In other words, the rotation direction of the photoconductor drum 11 is set to a clockwise direction as illustrated in FIG. 2. On the other hand, the rotation direction of the developing sleeve 141*a* is set to a counterclockwise direction. As a result, the outer circumferential surface of the developing sleeve 141*a* in the developing region facing the photoconductor drum 11 moves in the same direction as a moving direction of the surface of the photoconductor drum 11. The rotation direction of the developing sleeve 141*a* may be set to the same direction as the rotation direction of the photoconductor drum 11.

The supply transporting member 142 that includes a screw auger (supply auger) which pumps up the developer 4 in the developer housing chamber 146 and supplies to the developing roll 141 is disposed obliquely downward with respect to the developing roll 141 in the device housing 140. The agitation transporting member 143 that includes a screw auger (admix auger) which agitates and transports the developer 4 supplied into the device housing 140 is disposed on a rear surface side in the horizontal direction of the supply transporting member 142 in the device housing 140. The agitation transporting member 143 is rotation-driven in the clockwise direction by the driving device (not illustrated).

Since the supply transporting member 142 and the agitation transporting member 143 are housed in the lower housing 140*a*, a first housing portion 148 and a second housing portion 149 that are shaped into a substantially semi-cylinder are provided. The first housing portion 148 and the second housing portion 149 are partitioned by a partition wall 150 that is provided in the lower housing 140*a*.

Figure 3A:
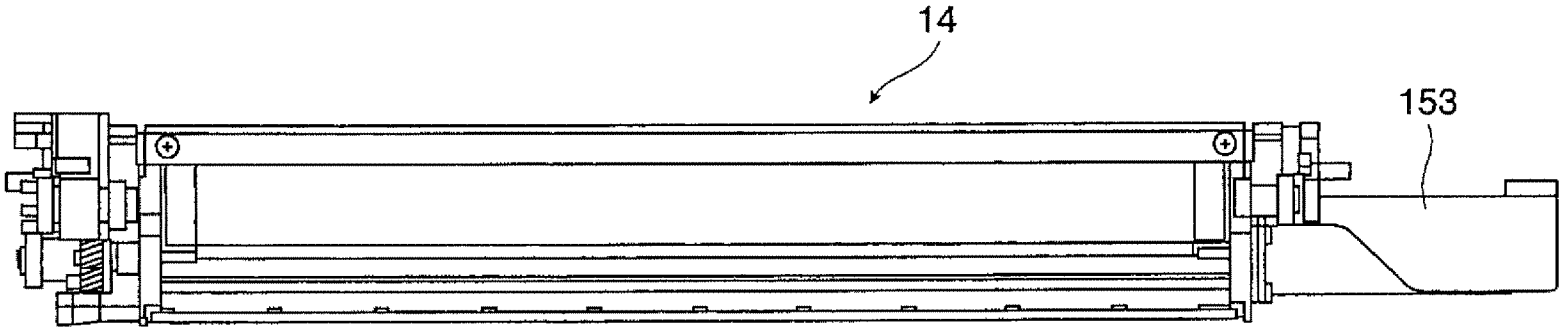
FIG. 3A is a front view illustrating a configuration of the developing device according to the first exemplary embodiment of the invention.
Figure 3B:
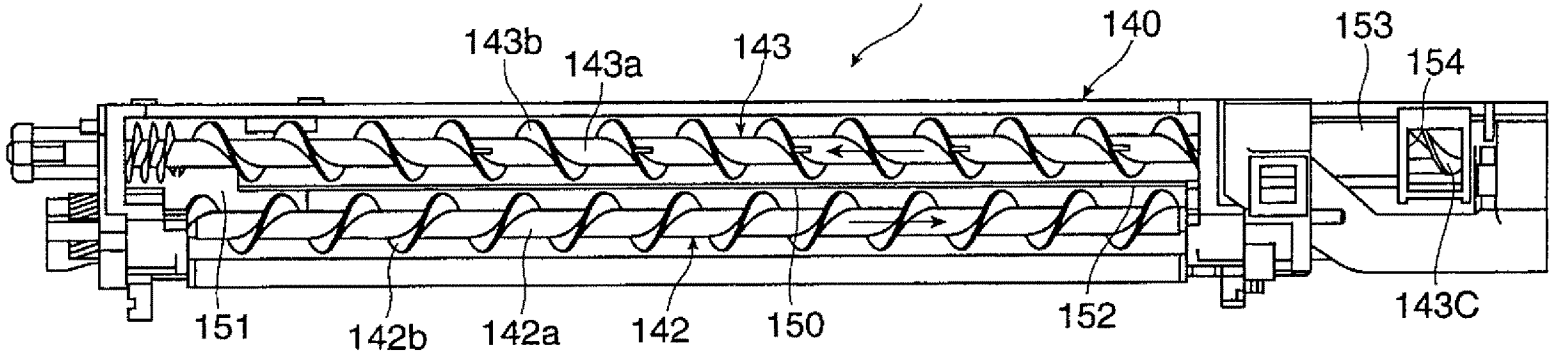
FIG. 3B is a plan view illustrating a configuration of the developing device excluding an upper housing.

In addition, first and second passage portions 151 and 152 that pass on the developer 4 are respectively provided at both ends in a longitudinal direction of the partition wall 150 between the supply transporting member 142 and the agitation transporting member 143 as illustrated in FIG. 3B. In addition, one end of the agitation transporting member 143 in the axial direction thereof extends so as to protrude toward a rear surface side of the device housing 140. A rectangular tubular supplying unit 153 corresponding to an extended portion 143*c* of the agitation transporting member 143 is provided so as to protrude in the device housing 140. In addition, a supply port 154 to which the developer 4 in a color corresponding to the toner cartridges 145 (Y, M, C, and K) is supplied is opened to an upper surface of the supplying unit 153.

The supply transporting member 142 and the agitation transporting member 143 have rotary shafts 142*a* and 143*a* that are shaped into a column, and transporting blades 142*b* and 143*b* that are shaped into a spiral so as to be integrated with the outer circumferences of the rotary shafts 142*a* and 143*a* in the axial direction as illustrated in FIG. 3B.

In the course of using the developing device 14, the developer 4 degrades with time by the toner, external additives of the toner, or the like being attached to the carrier that configure the two-component developer 4. The performance of the carrier to triboelectrically charge the toner deteriorates when the toner and the carrier are agitated and transported in a state of being mixed together. It is known that, once the performance of the carrier to triboelectrically charge the toner deteriorates, the toner does not get charged successfully and deterioration of image quality, including decreased concentration and fogging, attributable to unsuccessful charging occurs.

In the developing device 14 according to the exemplary embodiment, a so-called trickle development method is adopted in which excessive developer out of the developer 4 housed in the device housing 140 is gradually discharged to the outside while the developer 4 that contains the carrier is supplied to the device housing 140 of the developing device 14, in order to suppress the deterioration of image quality due to the unsuccessfully charged toner.

Figure 4:
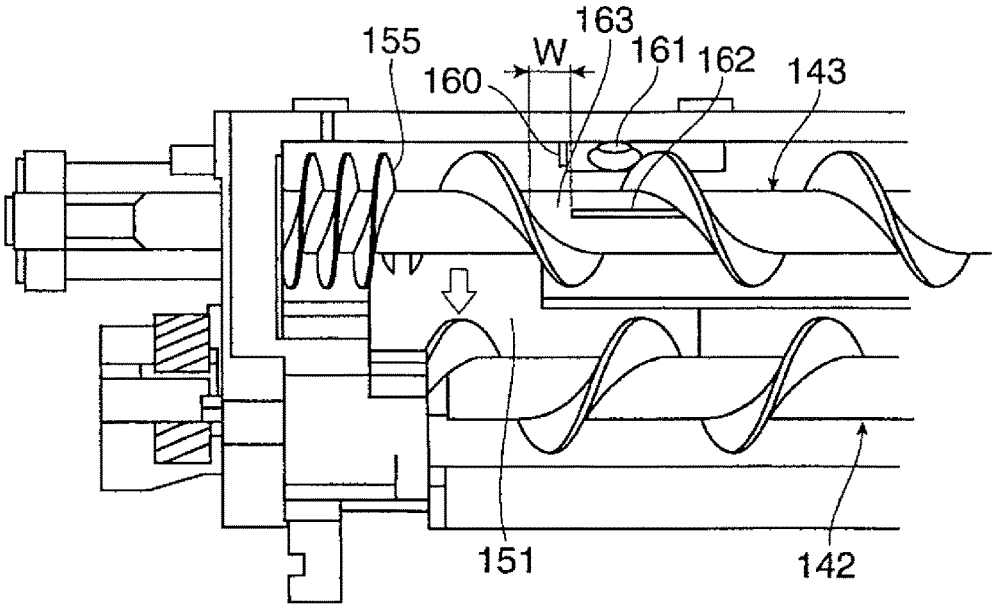
FIG. 4 is a plan view illustrating configurations of main parts of the developing device according to the first exemplary embodiment of the invention.

As illustrated in FIG. 4, in the device housing 140 of the developing device 14, the discharge transport blades 155 are provided in an end of the agitation transporting member 143 on a downstream side in the transport direction. The discharge transport blades 155 discharge the excess developer 4. A transport direction in which the discharge transport blades 155 transport the developer 4 is opposite to that in which the transport blades 143*b* of the agitation transporting member 143 transport the developer 4. In addition, a pitch of the discharge transport blades 155 is set to be narrower (smaller) than that of the transport blades 143*b* of the agitation transporting member 143. The discharge transport blade 155 has a lower developer transport capacity than the transport blade 143*b* of the agitation transporting member 143. The discharge transport blades 155 transport the developer 4, which is transported to the downstream side by the transport blades 143*b* of the agitation transporting member 143 in accordance with the rotation of the agitation transporting member 143, so as to push the developer 4 back to the upstream side. The developer 4 pushed back to the upstream side passes through the first passage portion 151, and then the developer 4 is passed onto the supply transporting member 142. Accordingly, a total amount of the developer 4 housed in the device housing 140 is usually maintained at a required value.

Figure 5:
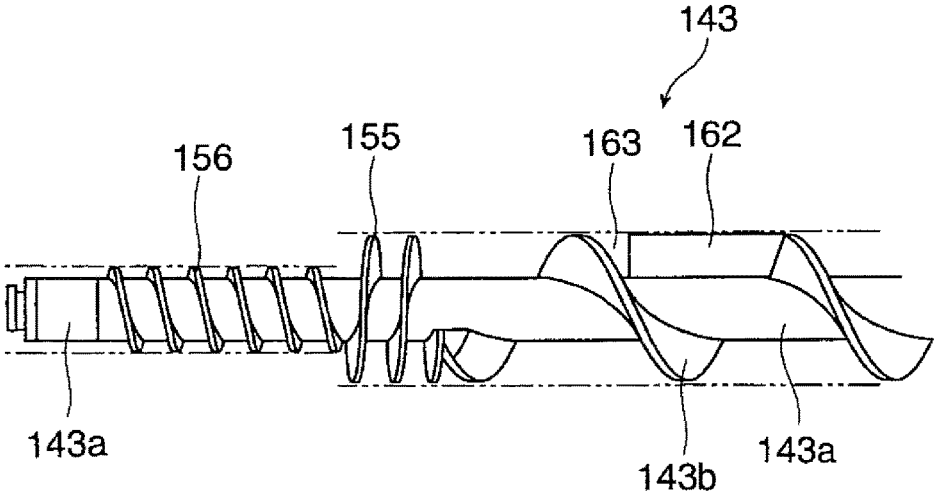
FIG. 5 is a front view illustrating a configuration of an agitation transporting member.

Excess developer out of the developer 4 that is housed in the second housing portion 149 and that is transported to the downstream side by the transport blades 143*b* of the agitation transporting member 143 crosses the discharge transport blades 155 and is transported to the downstream side in a case where the total amount of the developer 4 housed in the device housing 140 of the developing device 14 exceeds the required value. The agitation transporting member 143 is provided with auxiliary transport blades 156 downstream of the discharge transport blades 155 as illustrated in FIG. 5. The auxiliary transport blades 156 transport the developer 4 to the downstream side of the agitation transporting member 143 in the transport direction. A pitch of the auxiliary transport blades 156 is substantially equal to the pitch of the discharge transport blades 155, and the outer diameter of the auxiliary transport blade 156 is set to be smaller than that of the discharge transport blade 155. In addition, a transporting passage (not illustrated) formed in the outer circumference of the auxiliary transporting blade 156 is set to be small in accordance with the outer diameter of the auxiliary transporting blade 156. Accordingly, an amount of the developer transported by the auxiliary transport blades 156 is significantly smaller than an amount of the developer transported by the discharge transport blades 155. In addition, in the device housing 140 disposed in a front end of the auxiliary transporting blades 156 in the axial direction, a discharge port (not illustrated) that discharges the excess developer outside the device housing 140 is provided to open downward. The excess developer that has been discharged from the discharge port is recovered by a recovery device (not illustrated).

In addition, in the exemplary embodiment, a toner concentration sensor 160 that is an example of a detecting unit is provided upstream of the discharge transport blades 155 in the transport direction as illustrated in FIG. 4. The toner concentration sensor 160 detects a toner concentration of the developer 4 housed in the device housing 140. The discharge transport blades 155 discharges the excess developer in the developer 4. The toner concentration sensor 160 is disposed at a position adjacent to the end of the agitation transporting member 143 on the downstream side in the transport direction and adjacent to an upstream side of the first passage portion 151. A magnetic permeability sensor that acquires toner concentration in the developer 4 by detecting magnetic permeability of the developer 4 is used as the toner concentration sensor 160. As illustrated in FIG. 2, the toner concentration sensor 160 is provided such that a detecting unit 161 that is shaped into a column and that is attached to an inner wall of the second housing portion 149, which houses the agitation transporting member 143, is exposed.

Figure 6:
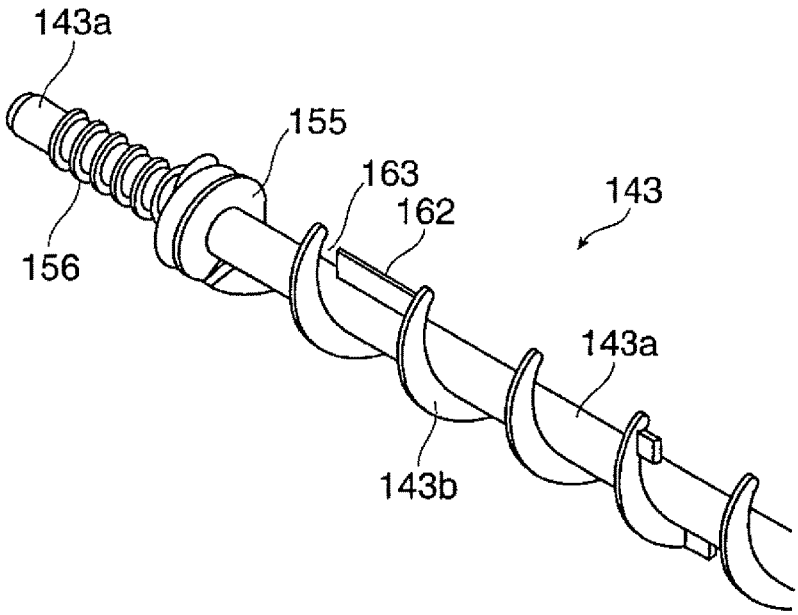
FIG. 6 is a perspective view illustrating the configuration of the agitation transporting member.

In addition, as an example of an agitating member, a flat plate shaped paddle 162 is provided so as to be integrated with the agitation transporting member 143 in a region facing the detecting unit 161 of the toner concentration sensor 160 as illustrated in FIG. 5 and FIG. 6. The paddle 162 suppresses that the developer 4 is attached to the detecting unit 161 due to agitating of the developer 4, which is in front of the detecting unit 161 of the toner concentration sensor 160, along a circumferential direction, resulting in occurrence of a detection error.

Figure 7:
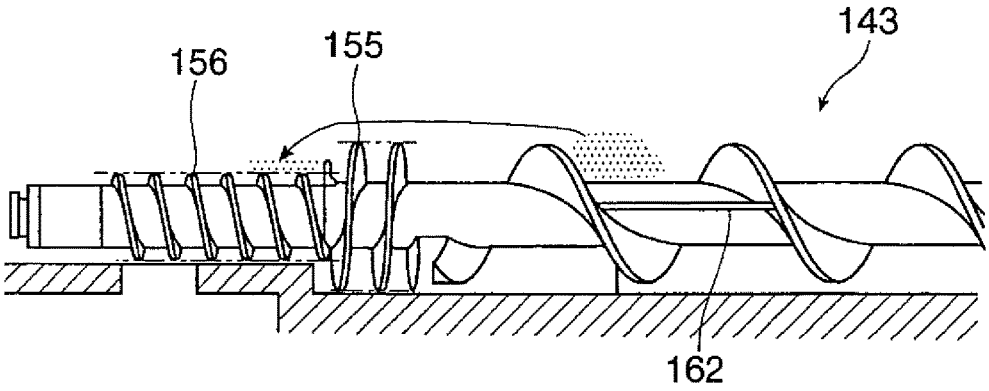
FIG. 7 is a configuration diagram illustrating an effect of an agitation transporting member in the related art.

Recently, there has been a tendency in which the developing device 14 that has the aforementioned configuration runs at a high speed as rotation speeds of the developing roll 141 and the agitation transporting member 143 as well as the photoconductor drum 11 are increased to meet a requirement for increased productivity of the image forming apparatus 1. It has been determined that the developer 4 housed in the second housing portion 149 is scrapped up and scattered beyond the discharge transport blades 155 by the paddle 162 agitating the developer 4 in the circumferential direction of the rotary shaft 143*a*, and the developer 4 reaches the auxiliary transport blades 156 in a case where the rotation speeds of the developing roll 141 and the like of the developing device 14 have increased as illustrated in FIG. 7.

Once the developer 4 that has been scrapped up by the paddle 162 of the agitation transporting member 143 reaches the auxiliary transporting blades 156, the developer 4 that should not be discharged because an amount of the developer housed in the second housing portion 149 does not exceed the required value ends up being discharged from the discharge port by the auxiliary transporting blades 156. Accordingly, the developer 4 housed in the device housing 140 is excessively discharged, and the total amount of the developer 4 in the device housing 140 decreases so as to be smaller than the amount that the developer should remain in the device housing 140. Then, the amount of the developer 4 supplied to the developing roll 141 by the supply transporting member 142 decreases, and image quality defects, including decreased concentration, may occur on the image that should be developed on the surface of the photoconductor drum 11.

In the exemplary embodiment, as illustrated in FIG. 4 and FIG. 5, a cutout portion 163 that is an example of a non-application portion that prevents action of a force for transporting the developer 4 radially outward from the rotary shaft 143*a* is provided in the paddle 162, in order to suppress the occurrence of excessive discharge of the developer 4 that is caused by the increased rotation speeds of the developing roll 141 and the like.

Furthermore, in the region facing the detecting unit 161 of the toner concentration sensor 160, the paddle 162 of the developing device 14 according to the exemplary embodiment is provided with the cutout portion 163 that has a required width W, in a portion connected to the transporting blade 143*b* located downstream of the agitation transporting member 143 in the developer transport direction as illustrated in FIG. 4 and FIG. 5. The cutout portion 163 provided in the paddle 162 is configured as the non-application portion that cannot permit action of a force for transporting the developer 4 radially outward because the cutout portion 163 does not come into contact with the developer 4 even in a case where the paddle 162 has rotated.

On the other hand, the paddle 162 in the related art is provided in the transport direction of the agitation transporting member 143 as if the paddle 162 connects the adjacent transporting blades 143*b* as illustrated in FIG. 7. Accordingly, in a case where the paddle 162 has been rotated, the entire region of the paddle 162 in the transport direction comes into contact with the developer 4, and a force for transporting the developer 4 radially outward acts. Therefore, once the rotation speeds of the developing roll 141, the agitation transporting member 143, and the like are increased, the developer 4 gets scrapped up and scattered.

Operation of Characteristic Portions of Developing Device

In the developing device 14 according to the first exemplary embodiment, each of the developing roll 141, the supply transporting member 142, and the agitation transporting member 143 is rotation-driven by the driving device (not illustrated) in the directions indicated by the arrows, in accordance with an image forming operation as illustrated in FIG. 2. The developer 4 housed in the device housing 140 is agitated and transported in accordance with the rotations of the supply transporting member 142 and the agitation transporting member 143, and is supplied from the supply transporting member 142 to the developing roll 141. Then, the developer 4 is transported to the developing region facing photoconductor drum 11 by the developing roll 141, and the electrostatic latent image is developed on the surface of the photoconductor drum 11.

In addition, developer is newly supplied from the supply port 154 to the device housing 140 at required timing as illustrated in FIG. 3B. The developer newly supplied to the device housing 140 is agitated with the developer 4 housed in the device housing 140 while the new developer is transported by the agitation transporting member 143. Then the developer is transported to the supply transporting member 142 via the first and second passage portions 151 and 152 to be supplied to the developing roll 141.

As described above, once the new developer is gradually supplied to the device housing 140 of the developing device 14, the total amount of the developer 4 housed in the device housing 140 exceeds the required value. In a case where the total amount of the developer 4 housed in the device housing 140 has exceeded the required value, the excess developer out of the developer 4 that is housed in the second housing portion 149 and that is transported to the downstream side by the transport blades 143*b* of the agitation transporting member 143 crosses the discharge transport blades 155 and is transported to the downstream side as illustrated in FIG. 4 and FIG. 5. Then, the excess developer is discharged by the auxiliary transport blades 156 from the discharge port (not illustrated) of the device housing 140 to the outside.

There is a tendency in which the developing device 14 that has the aforementioned configuration runs at a high speed as the rotation speeds of the developing roll 141, the agitation transporting member 143, and the like are increased to meet the requirement for increased productivity of the image forming apparatus 1. The developer 4 housed in the second housing portion 149 becomes likely to be scrapped up and scattered by the paddle 162 of the agitation transporting member 143 in a case where the rotation speeds of the developing roll 141 and the like of the developing device 14 have increased.

Figure 8:
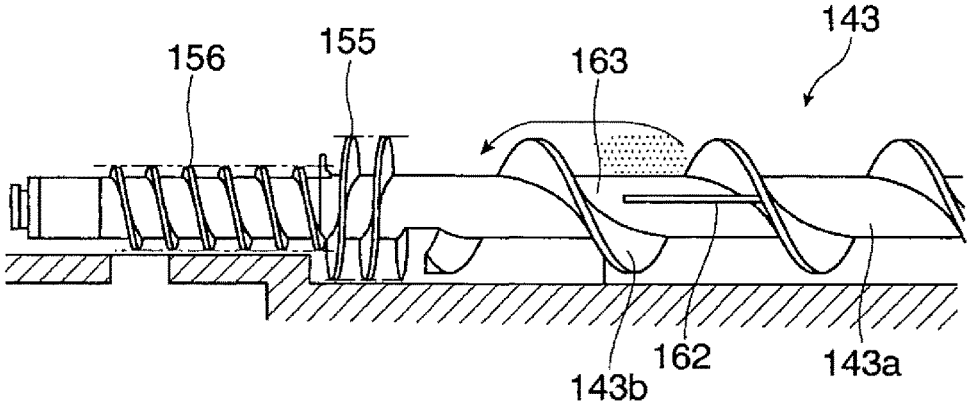
FIG. 8 is a configuration diagram illustrating an effect of the agitation transporting member according to the first exemplary embodiment.

In the exemplary embodiment, as illustrated in FIG. 4 and FIG. 5, the cutout portion 163 is provided in the end of the paddle 162 on the downstream side in the developer transport direction. The cutout portion 163 prevents action of the force for transporting the developer 4 outward in radial directions of the rotary shaft 143*a*. Accordingly, as illustrated in FIG. 8, in the paddle 162 of the developing device 14 according to the exemplary embodiment, the amount of the developer 4 scrapped up by the paddle 162 in accordance with the rotation of the agitation transporting member 143 decreases by a size of the cutout portion 163 provided. That is, the cutout portion 163 suppresses the developer 4 scrapped up and scattered by the paddle 162 from crossing the discharge transport blades 155 and reaching the auxiliary transport blades 156 located on the downstream side.

Accordingly, the developing device 14 according to the exemplary embodiment suppress or prevent the developer 4 from being scrapped up and scattered by the paddle 162, reaching the auxiliary transporting blades 156, and being discharged from the discharge port by the auxiliary transporting blades 156 even in a case where the rotation speeds of the developing roll 141, the agitation transporting member 143, and the like have been increased. For this reason, the developing device 14 may maintain the total amount of the developer 4 in the device housing 140 at an approximately appropriate value and avoid the occurrence of decreased developing concentration and the like even in a case where the rotation speeds of the developing roll 141, the agitation transporting member 143, and the like have been increased.

Experiment Example

The inventors produce a benchmark model of a image forming apparatus 1 as illustrated in FIG. 2 and conducts an experiment to confirm a total amount of the developer 4 in the device housing 140 of the developing device 1,4 in order to confirm effects of the developing device according to the first exemplary embodiment described above. The productivity of the image forming apparatus 1 is set to 100 ppm at which 100 images per minute are printed onto A4 size recording paper 5.

Figure 9:
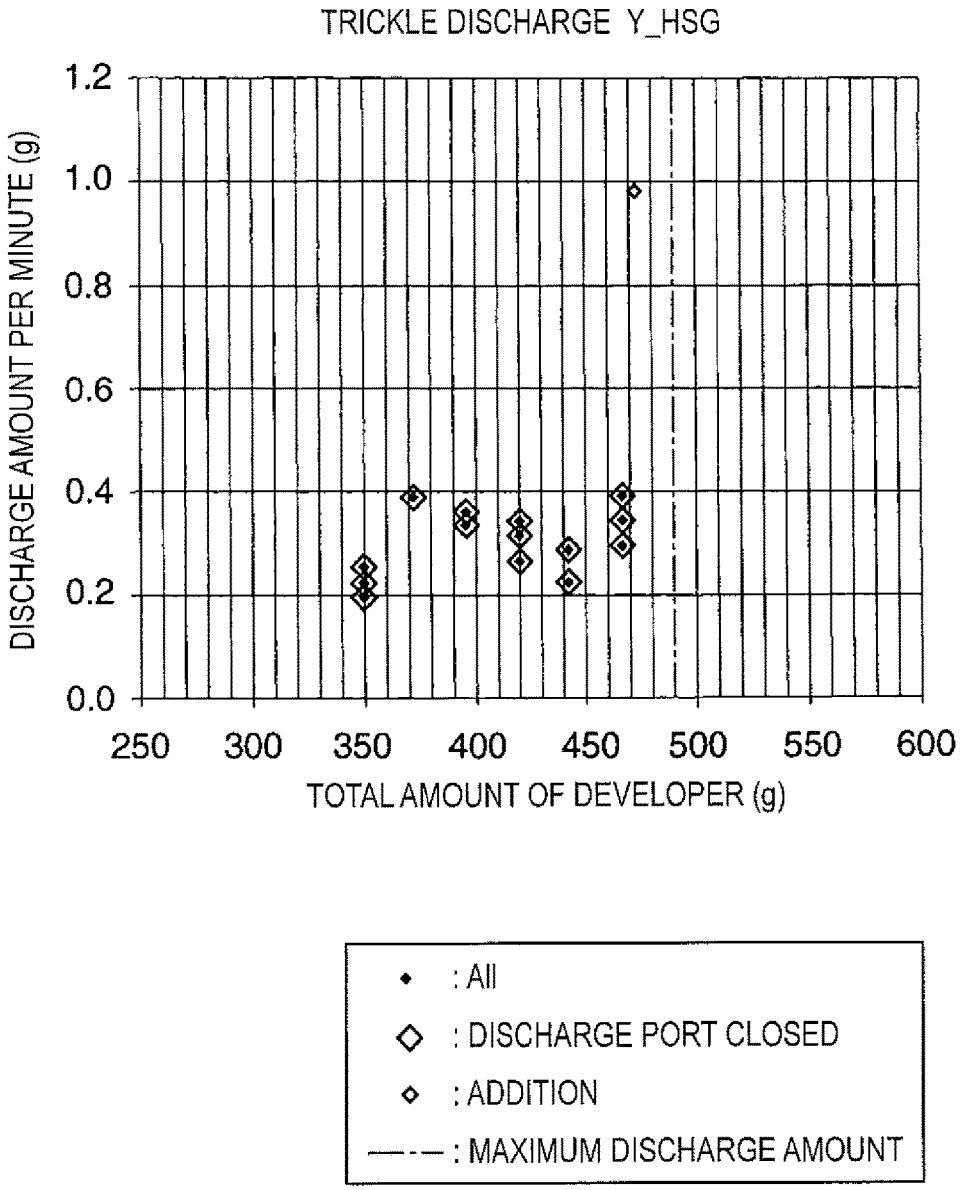
FIG. 9 is a graph illustrating an experiment example.

FIG. 9 is a graph illustrating the results of an experiment example.

As is apparent from FIG. 9, it is determined that total amounts of the developer 4 in the device housing 140 of the developing device 14 have substantially reached a set value of 480 g.

Figure 10:
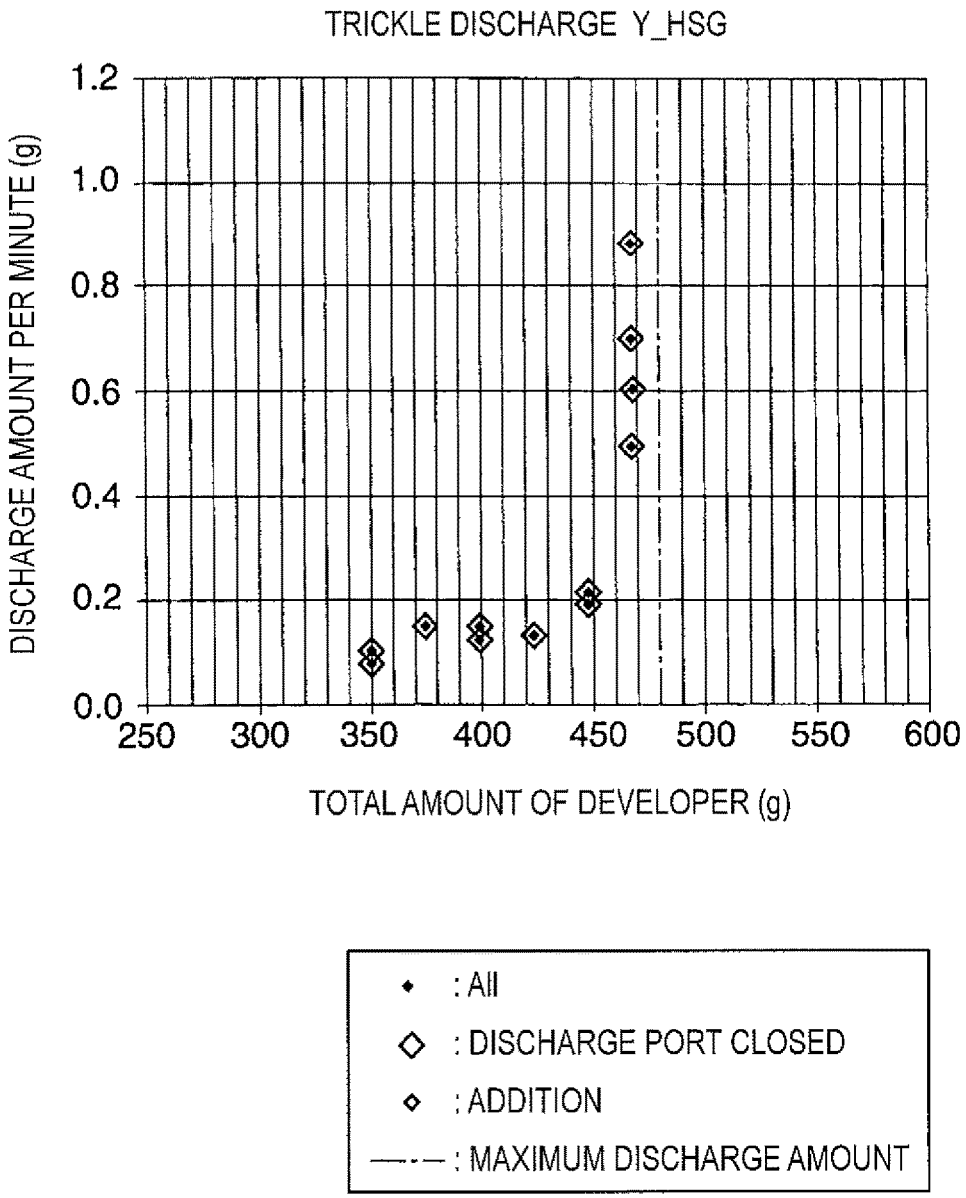
FIG. 10 is a graph illustrating a reference example.

FIG. 10 is a graph illustrating the results of a reference example. In the reference example, the paddle 162 has been removed altogether from the agitation transporting member 143, and the paddle 162 has been configured such that the force for transporting the developer 4 radially outward does not act at all.

In the case of the reference example, as is apparent from FIG. 10, it is determined that once the total amount of the developer 4 in the device housing 140 substantially approaches the set value of the 480 g, a developer discharge amount per minute may be increased rapidly and the total amount of the developer 4 in the device housing 140 may be maintained approximately at the set value even if the rotation speeds of the developing roll 141 and the like are increased to a speed corresponding to the productivity of 100 ppm.

Comparative Example

As a comparative example, the inventors produce a benchmark product of a image forming apparatus I that employs the developing device 14 of the related art in which the paddle 162 is provided over the entire region between the adjacent transporting blades 143*b* in the developer transport direction of the agitation transporting member 143 as illustrated in FIG. 7. Then, the inventors conduct an experiment to confirm a total amount of the developer 4 in the device housing 140 of the developing device 14. The productivity of the image forming apparatus 1 is set to 100 ppm at which 100 images per minute arc printed onto A4 size recording paper 5.

Figure 11:
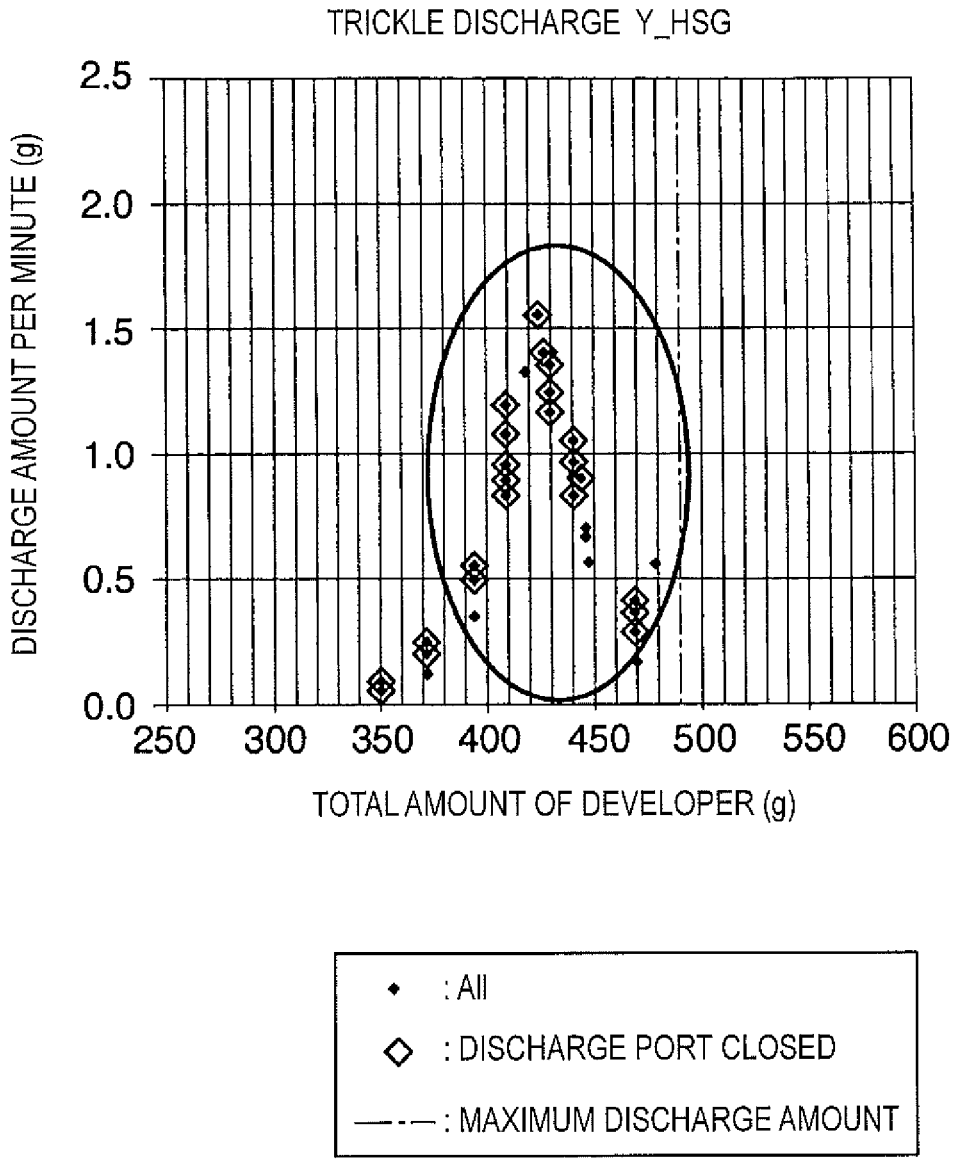
FIG. 11 is a graph illustrating a comparative example.

FIG. 11 is a graph illustrating the results of the comparative example. The scale of the vertical axis of FIG. 11 is different from those of FIG. 9 and FIG. 10.

As is apparent in FIG. 11, it is determined that the developer discharge amount increases rapidly and the developer 4 in the device housing 140 is excessively discharged before the total amount of the developer 4 in the device housing 140 of the developing device 14 substantially approaches the set value of 480 g.

As described above, according to the exemplary embodiment, the paddle 162 that retains the developer 4 in the region corresponding to the toner concentration sensor 160 well suppress the excessive discharge of the developer 4 compared with a case where the non-application portion that prevents action of the power for transporting the developer 4 radially outward is not provided.

Second Exemplary Embodiment

FIGS. 12A to 12G are enlarged views illustrating main parts of the developing device according to a second exemplary embodiment of the invention.

In the second exemplary embodiment, the shape of each cutout portion 163 provided in the paddle 162 differs from each other as illustrated in FIGS. 12A to 12G.

Figure 12A:
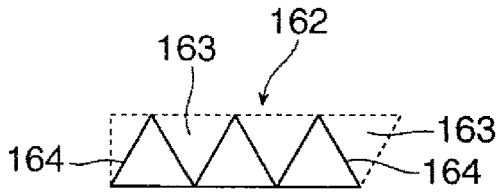
FIGS. 12A to 12G are configuration diagrams each illustrating main parts of a developing device according to a second exemplary embodiment of the invention.

In the exemplary embodiment illustrated in FIG. 12A, the paddle 162 is configured with plural plate members 164 each of which has a substantially regular triangle shape in front view. The cutout portions 163 are provided between the plate members 164 and on the downstream side of the paddle 162 in the developer transport direction.

Figure 12B:
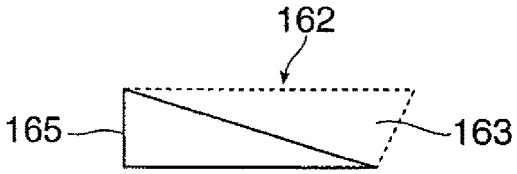

In the exemplary embodiment illustrated in FIG. 12B, the paddle 162 is configured with a plate member 165. The plate member 165 has such a triangle shape that a height of the triangle gets smaller linearly from the upstream side toward the downstream side in the developer transport direction. The cutout portion 163 is provided on the plate member 165.

Figure 12C:
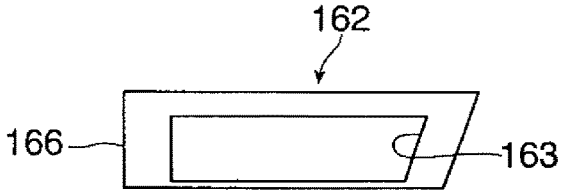

In the exemplary embodiment illustrated in FIG. 12C, the cutout portion 163 is provided in the paddle 162 having a flat plate shape. An area of the cutout portion 163 increases toward the downstream side in the developer transport direction.

Figure 12D:
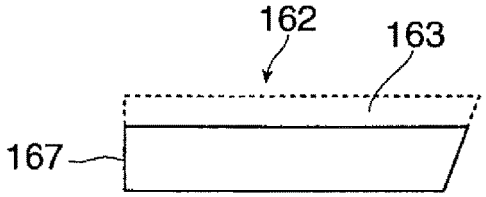

In the exemplary embodiment illustrated in FIG. 12D, the cutout portion 163 is provided in an upper portion of the paddle 162 that is feinted as a flat plate 167. An area of the cutout portion 163 increases toward the downstream side in the developer transport direction.

Figure 12E:
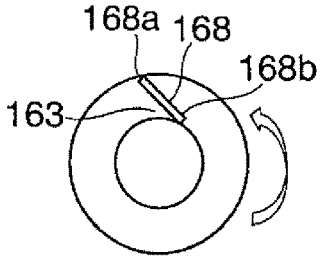

In the exemplary embodiment illustrated in FIG. 12E, the paddle 162 that is formed as a flat plate 168 is disposed such that the tip portion 168*a* at the outer circumference of the rotary shaft 143*a* is tilted toward the upstream side in the rotation direction. The cutout portion 163 that prevents action of a force for transporting the developer radially outward is provided at a base end portion 168*b* of the flat plate 168.

Figure 12F:
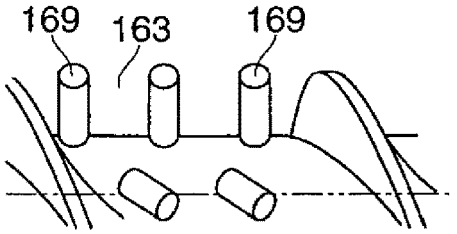

In the exemplary embodiment illustrated in FIG. 12F, the paddle 162 is configured of plural rod-like members 169, instead of a flat plate, which are erected on the outer circumference of the rotary shaft 143*a*, and the cutout portions 163 that prevents action of the force for transporting the developer radially outward is provided between the plural rod-like members 169.

Figure 12G:
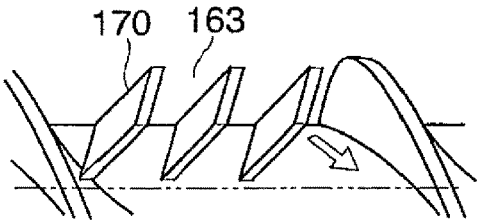

In the exemplary embodiment illustrated in FIG. 12G, the paddle 162 is configured of plural flat plate shaped members 170, instead of an unbroken flat plate, which are erected so as to be tilted on the outer circumference of the rotary shaft 143*a*, and the cutout portions 163 that prevents action of the force for transporting the developer radially outward is provided between the plural flat plate shaped members 170.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holding member that holds a developer;

a supply transport member that supplies the developer to the developer holding member;

an agitation transport member that transports the developer while passing the developer onto the supply transport member through a passage portion, the agitation transport member including a discharge transport blade that discharges excess developer and that is provided downstream of the passage portion in a transport direction, wherein the agitation transport member includes:

a rotary shaft; and a transporting blade that is integrated with an outer circumference of the rotary shaft and that is shaped into a spiral in an axial direction of the rotary shaft;

a detecting unit that is provided upstream of the discharge transport blade in the transport direction of the agitation transport member and that detects a toner concentration in the developer transported by the agitation transport member; and a paddle positioned in a region corresponding to the detecting unit in the transport direction such that the paddle faces the detecting unit and passes over the detecting unit during rotation of the rotary shaft, the paddle including a non-application portion that prevents action of a force for transporting the developer radially outward, the paddle retaining the developer in a region corresponding to the detecting unit of the agitation transport member, wherein the paddle is positioned between the spiral of the transporting blade.

2. The developing device according to claim 1, wherein the paddle includes flat plate shaped members provided on an outer circumference of a rotary shaft of the agitation transport member to be directed in radial directions, and the non-application portion is formed by cutting out a part of the flat plate shaped member.

3. The developing device according to claim 1, wherein the paddle includes columnar members that protrude in radial directions on an outer circumference of a rotary shaft of the agitation transport member, and the columnar members are provided at intervals along the transport direction and a circumferential direction of the agitation transport member.

4. The developing device according to claim 1, wherein the paddle includes rectangular members that protrude in a radial direction on an outer circumference of a rotary shaft of the agitation transport member and that tilt in a direction intersecting an axial direction, and the rectangular members are provided at intervals along the transport direction of the agitation transport member.

5. An image forming apparatus comprising:

an image carrier that carries an electrostatic latent image; and the developing device according to claim 1, the developing device developing the electrostatic latent image on the image carrier.

6. An image forming apparatus comprising:

an image carrier that carries an electrostatic latent image; and the developing device according to claim 2, the developing device developing the electrostatic latent image on the image carrier.

7. An image forming apparatus comprising:

an image carrier that carries an electrostatic latent image; and the developing device according to claim 3, the developing device developing the electrostatic latent image on the image carrier.

8. An image forming apparatus comprising:

an image carrier that carries an electrostatic latent image; and the developing device according to claim 4, the developing device developing the electrostatic latent image on the image carrier.

9. The developing device according to claim 1, wherein the paddle and the non-application portion are adjacent with each other.

10. The developing device according to claim 1, wherein the detecting unit is disposed at a position adjacent to an end of the agitation transport member on the downstream side in the transport direction, and wherein the paddle is connected to a portion of the transporting blade at a location upstream of the detecting unit in the transport direction.

* * * * *